US006675493B1

(12) United States Patent
Martin

(10) Patent No.: US 6,675,493 B1
(45) Date of Patent: Jan. 13, 2004

(54) BAG DRYER

(76) Inventor: Rosemary Martin, 16 W. Thomas St., Avon Park, FL (US) 33825

( * ) Notice: Subject to any disclaimer, the term of this patent is extended or adjusted under 35 U.S.C. 154(b) by 0 days.

(21) Appl. No.: 10/100,373

(22) Filed: Mar. 18, 2002

(51) Int. Cl.[7] ..... F26B 25/00

(52) U.S. Cl. ..... 34/240; 34/103; 34/104; 248/95

(58) Field of Search ..... 34/103, 104, 105, 34/166, 239, 240; 211/85.15, 12, 86.01, 126.11, 126.12; 248/94, 95

(56) References Cited

U.S. PATENT DOCUMENTS

| | | | | | |
|---|---|---|---|---|---|
| 3,295,694 | A | * | 1/1967 | Nejezchleb et al. | 211/126 |
| D243,313 | S | * | 2/1977 | Varnado | D7/196 |
| D322,344 | S | * | 12/1991 | Winkler | D32/58 |
| 5,080,237 | A | * | 1/1992 | Hefner | 211/13 |
| 5,121,681 | A | * | 6/1992 | Chang | 108/25 |
| 5,188,244 | A | * | 2/1993 | Hollstegge | 211/71 |
| 5,405,018 | A | * | 4/1995 | Anthrop | 211/13 |
| 5,406,717 | A | * | 4/1995 | Dofka | 34/104 |
| 5,421,542 | A | * | 6/1995 | Crutcher | 248/95 |
| 5,641,137 | A | * | 6/1997 | Collier | 248/95 |
| 5,901,861 | A | * | 5/1999 | Huguet | 211/85.15 |
| 6,012,687 | A | * | 1/2000 | Head | 248/100 |
| 6,059,126 | A | * | 5/2000 | Miller | 211/85.15 |
| 6,125,548 | A | * | 10/2000 | Dunn et al. | 34/104 |
| 6,243,967 | B1 | * | 6/2001 | Dovolas | 34/103 |
| D460,295 | S | * | 7/2002 | Fissell et al. | D6/467 |

* cited by examiner

*Primary Examiner*—K. B. Rinehart

(57) ABSTRACT

A holder for drying plastic bags including a base with series of interconnected sockets; and dowels, each dowel having a smooth and rounded end, to accommodate a bag and an opposite end being inserted into the sockets of the base. A bag is placed upside-down over the dowels to dry. The dowels may be positioned in different sockets to accommodate different size bags. Alternatively, the end of the dowel being placed in the base may be hollow thereby accommodating a spring placed between the sockets of the base and the dowels so that the dowels may be easily adjusted. The bag holder may optionally provide a horizontal attachment to permit simultaneous drying of a plastic bag and a dish towel.

19 Claims, 3 Drawing Sheets

BAG DRYER

BACKGROUND OF THE INVENTION

1. Field of the Invention

The present invention relates to a device for holding plastic bags for drying.

2. Description of the Prior Art

The use of bag dryers is known in the prior art. For example, U.S. Pat. No. 6,012,687 to Head discloses a plastic bag holding device for holding open a plastic bag while it is being filled where the device comprises a base and pegs inserted therein.

U.S. Pat. No. 5,188,244 to Hollstegge discloses a drying rack for freezer bags including a support base, a plurality of rods and a head member where a bag to be dried is placed over the head member in an inverted position.

U.S. Pat. No. 5,641,137 to Collier discloses a bag dryer having a plurality of dowel pairs attached to a base at one end and rotatably joined with a rivet to from an "X" configuration.

U.S. Pat. No. 5,080,237 to Hefner discloses a holder for washing and drying bags having a frame with two arms pivotally joined at their ends.

U.S. Pat. No. 3,295,694 to Nejezchleb et al. discloses a drying rack for plastic bags including a tray and a plurality of bag-supporting members mounted on the tray where the members are substantially U-shaped.

Lastly, U.S. Pat. No. Des. 243,313 to Varnado discloses a drying rack for gloves including a base and cylindrical rods inserted therein.

While the above-described devices fulfill their respective, particular objectives and requirements, the aforementioned patents do not describe a bag dryer with dowels inserted into a series of interconnected sockets in a base, the dryer being adjustable to accommodate different size bags. The Head patent provides for placement of a plastic bag on four pegs, where only the position of one peg is adjustable. Further, in the teachings of the Head patent, the bag is held in an upright position, and such a position would not be effective for drying a washed plastic bag. Neither the Hollstegge, Hefner, Varnado, nor Nejezchleb patents provide for placement of a bag over two dowels for drying. The Collier patent provides dowels fixedly placed in a base and rotatable about a fixed axis but does not provide adjustment to accommodate different size bags by placement of dowels in different interconnected sockets in the base.

Therefore, a need exists for a new and improved bag dryer, which can be used to dry several size plastic bags and/or a dishrag simultaneously. In this regard, the present invention substantially fulfills this need. In this respect, the bag dryer according to the present invention substantially departs from the conventional concepts and designs of the prior art, and in doing so provides an apparatus primarily developed for the purpose of drying plastic bags.

SUMMARY OF THE INVENTION

In view of the foregoing disadvantages inherent in the known types of bag dryers now present in the prior art, the present invention provides an improved bag dryer, and overcomes the above-mentioned disadvantages and drawbacks of the prior art. As such, the general purpose of the present invention, which will be described subsequently in greater detail, is to provide a new and improved bag dryer which has all the advantages of the prior art mentioned heretofore and many novel features that result in a protective which is not anticipated, rendered obvious, suggested, or even implied by the prior art, either alone or in any combination thereof.

To attain this, the one embodiment of the holder for drying at least one bag of the present invention essentially comprises: a base having series of interconnected sockets; and at least two dowels, each dowel having a pair of opposite ends and a length extending between the ends, one of said ends being smooth and rounded, to accommodate a bag without tearing or puncturing thed bag and the opposite end being inserted into the sockets of the base, wherein the dowels are positioned within the base so that when a bag is placed over the dowels, an air space between the bag and the base permits air drying of the interior and exterior of the bag and the dowels may be positioned in different sockets of the base to accommodate different size bags.

A second embodiment of the holder for drying at least one bag of the present invention essentially comprises: a base having series of interconnected sockets; at least two dowels, each dowel having a pair of opposite ends and a length extending between the ends, one of said ends being smooth and rounded, to accommodate a bag without tearing or puncturing said bag and the opposite end being hollow; a spring and spring support to be placed between the sockets of the base and the hollow end of the dowel when the dowels are placed into the sockets of the base.

A third embodiment of the holder for drying at least one bag of the present invention is presented wherein at least two dowels of the holder further comprise a slot extending inward from the smooth and rounded end and the holder further comprises a horizontal attachment placed within the slots of the dowels.

There has thus been outlined, rather broadly, the more important features of the invention in order that the detailed description thereof that follows may be better understood and in order that the present contribution to the art may be better appreciated.

The invention may also include variations of the bag dryer. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bag dryer that has all of the advantages of the prior art protective coatings and none of the disadvantages.

It is another object of the present invention to provide a new and improved bag dryer which may be easily and efficiently manufactured and marketed.

It is further object of the present invention to provide a new and improved bag dryer which is of a durable and reliable construction.

An even further object of the present invention is to provide a new and improved bag dryer which is susceptible of a low cost of manufacture with regard to both materials and labor, and which accordingly is then susceptible of low prices of sale to the consuming public, thereby making such bag dryer economically available to the buying public.

Still another object of the present invention is to provide a new bag dryer which provides in the apparatuses and methods of the prior art some of the advantages thereof, while simultaneously overcoming some of the disadvantages normally associated therewith.

Even still another object of the present invention is to provide a bag dryer that features a dowel design to hold a washed bag upside-down and in an open position thereby allowing water to drain from the bag to permit drying of the inside and outside of the bag.

Another object of the present invention is to provide a bag dryer that is adjustable to accommodate a variety of bag sizes, such as pint, quart, and gallon size plastic bags.

Yet another object of the present invention is to provide a bag dryer that provides considerable amount of air space between the dowels on the base to allow water to be effectively drained from the bag.

Another object of the present invention is to provide a bag dryer that may be used to dry multiple bags simultaneously.

Yet another object of the present invention is to provide a bag dryer that provides and optional horizontal attachment to permit plastic bags and a dish rag or the like to be dried simultaneously.

Still yet another object of the present invention is to provide a bag dryer produced from plastic or wood and in a variety of colors and assorted shapes to match the decor of any kitchen.

Yet another object of the present invention is to provide a bag dryer that maybe used to prolong the usefulness of plastic refrigerator and freezer storage bags thereby saving the individual money by preventing the wastage of plastic storage bags.

Still even another object of the present invention is to provide a bag dryer that is useful to individual who recycle and would benefit the environment by preventing waste of plastic storage bags.

Still another object of the present invention is to provide a bag dryer that is adjustable, simple to use and durable for years of effective use.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
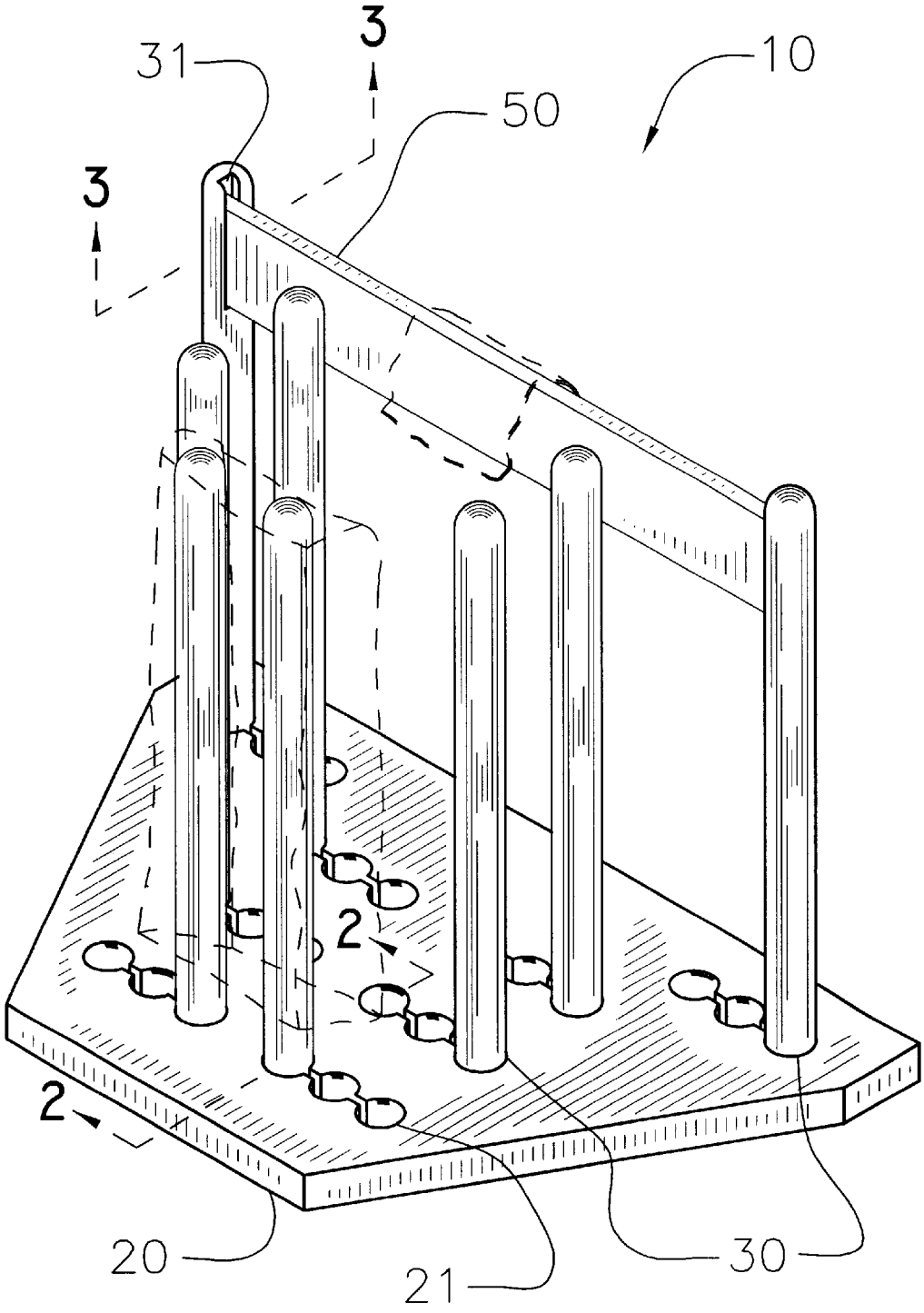
FIG. 1 is a perspective view of the present invention.

Referring now to the drawings, particularly FIG. 1, a preferred embodiment of the bag dryer embodying the principles and concepts of the present invention and generally designated by the reference numeral 10 will be described.

The base 20 is made of a rigid material such as wood or plastic and contains series of interconnected sockets 21, which can accommodate one end of a dowel 30. The dowels 30 are formed of rigid material such as wood or plastic, each dowel having a pair of opposite ends and a length extending between the ends, one of the ends being smooth and rounded, to accommodate a bag without tearing or puncturing the bag and the opposite end being inserted into the sockets of the base. The dowels 30 may be moved between the sockets 21 of the base 20 to accommodate different size bags. An inverted plastic bag, indicated by a dotted line, is placed over a pair of dowels 30 for drying so that there is sufficient air space between the bag and the base to permit the interior of the bag to dry.

Figure 2:
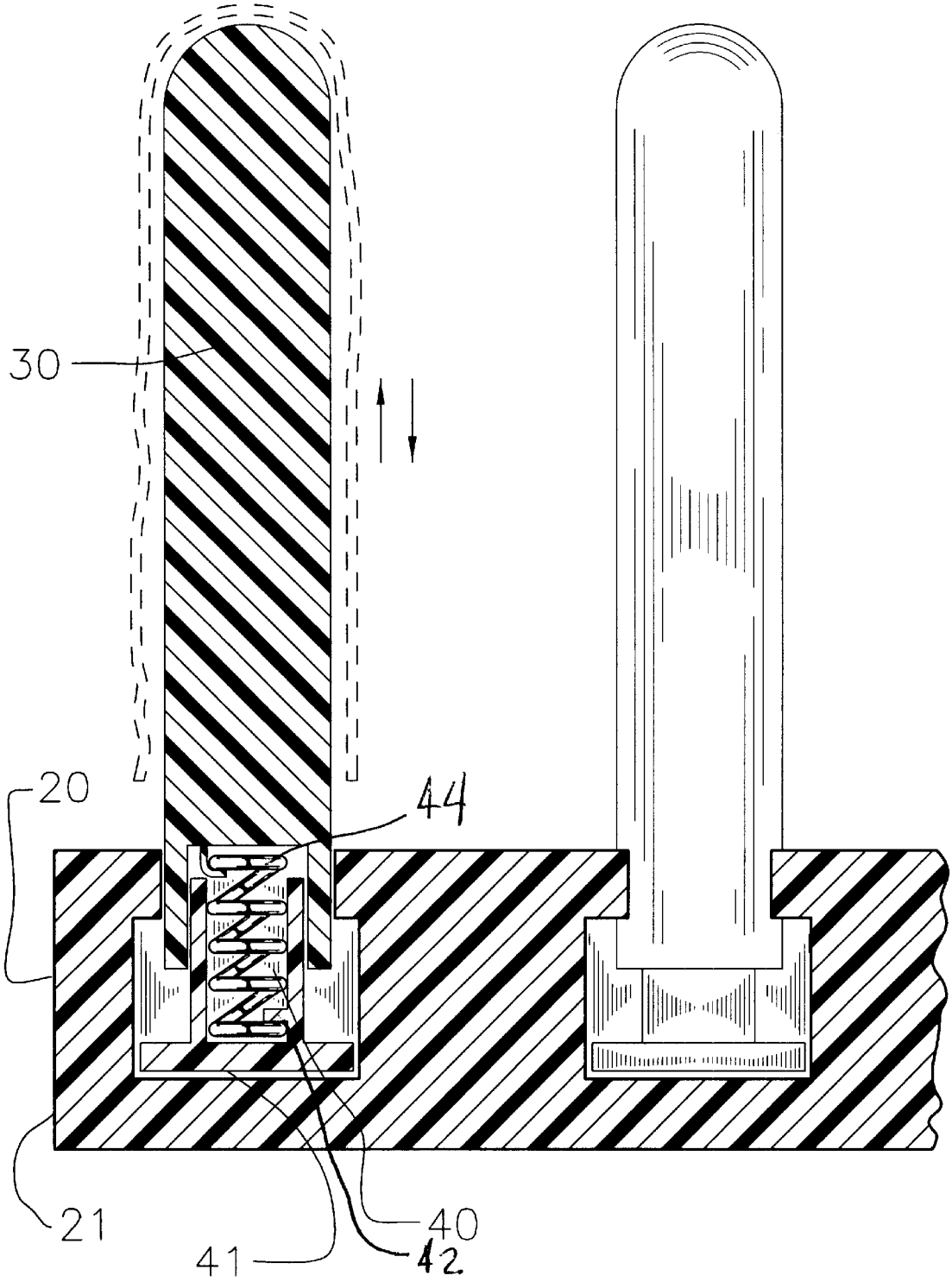
FIG. 2 is a cut away section of the base of the present invention along the line 2—2 of FIG. 1.

The second embodiment of the bag dryer of the present invention is further described in FIG. 2. In this embodiment, the end of the dowel 30 being inserted into the sockets 21 of the base 20 is hollow and the bag dryer further comprises a spring 40 and spring support 41. The end of the dowel 30 being inserted into the base 20 is hollow to a sufficient extent to accommodate the spring 40 and not impair the strength of the entire dowel. The spring 40 has one end attached to the hollow end of the dowel 30 by a spring hook 44. The opposing end of the spring 40 is attached to the spring support 41 by a spring retainer 42. The spring retainer is connected to the sidewall of the spring support 41 adjacent to the spring retainer's 42 closed end.

Figure 3:
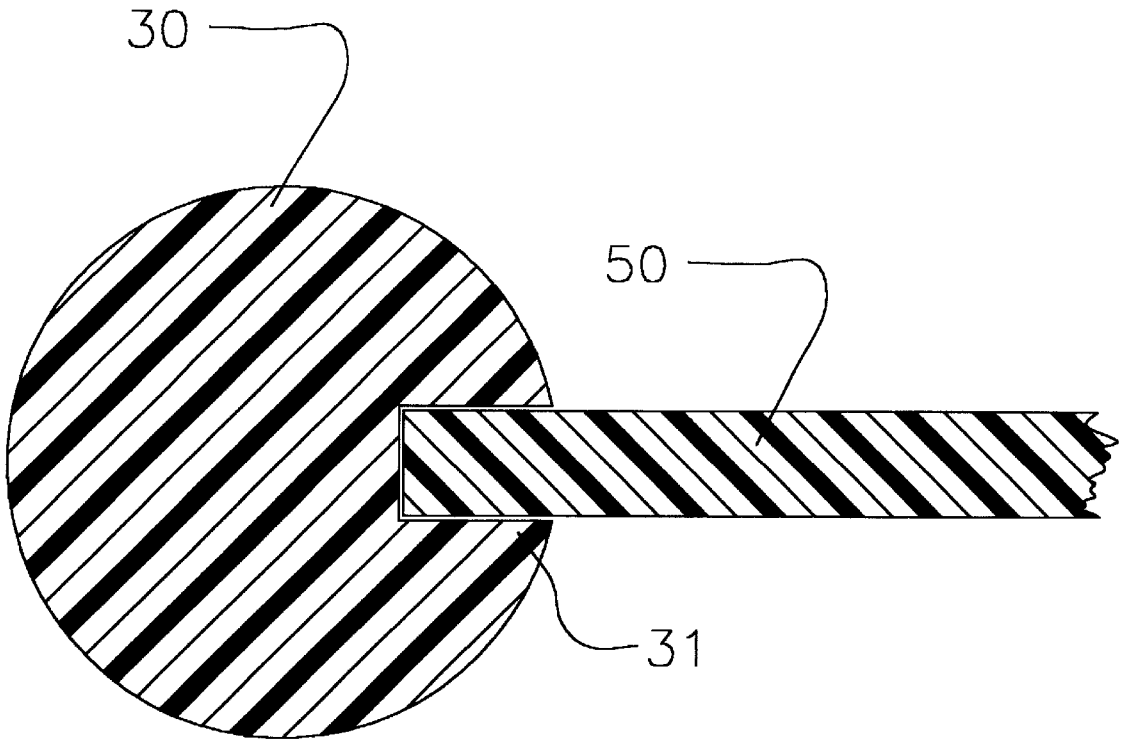
FIG. 3 is a cut away section of the dowel and horizontal attachment of the present invention along the line 3—3 of FIG. 1.

The third embodiment of the bag dryer of the present invention is further described in FIGS. 1 and 3. In this embodiment, at least two dowels 30 are further provided with a slot 31 extending inwardly from the smooth and rounded end of the dowel 30 of a length sufficient to accommodate a horizontal attachment 50. The horizontal attachment 50 is made of a rigid material such as wood or plastic and may be easily added or removed from the bag dryer depending upon the needs of the user. For example, addition of the horizontal attachment 50 would permit simultaneous drying of a plastic bag and a dish rag, indicated by a dotted line across the horizontal attachment 50, in FIG. 1.

Numerous variations and modifications of the bag dryer are envisioned. For example the bag dryer may be made of any sturdy water resistant material, including for example plastic or sealed wood product. The bag dryer may be made in numerous styles and colors to suit any kitchen decor. The bag dryer of the present invention may have any number of dowels and the base may have any number of series of interconnected sockets. The dowels of the bag dryer may be of any suitable length or diameter.

While a preferred embodiment of the bag dryer has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the platform, dowels and horizontal attachment may be made of any sturdy water resistant material may be used in place of the plastic and sealed wood described. It should be appreciated that the bag dryer herein described is also suitable for drying a wide variety of bag shapes and sizes. Although a particular shape of bag dryer has been described, it should be appreciated that the bag dryer of the present invention may be of any size, shape or color.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A holder for drying at least one bag comprising:

a plurality of dowels having an open end and a closed end;

a plurality of spring hooks having opposing ends with one end attached to said open end of said dowels;

a plurality of spring supports having a sidewall, an open end, and a closed end with said open end inserted into said open end of said dowels;

a plurality of spring retainers attached to said sidewall of said spring supports;

a plurality of springs having opposing ends with one end attached to said opposing end of said spring hooks and said opposing end attached to said spring retainers; and a base having a top surface wherein said top surface defines a plurality of sockets therein to receive said open end of said dowels.

2. The holder for drying at least one bag as defined in claim 1, wherein said sockets are interconnected.

3. The holder for drying at least one bag as defined in claim 2, wherein said closed end of said dowels is smooth and rounded.

4. The holder for drying at least one bag as defined in claim 3, wherein said base is generally trapezoidal in shape.

5. The holder for drying at least one bag as defined in claim 4, further comprising:

a plurality of slots wherein said closed end of at least two of said dowels defines a slot therein to comprise said slots; and a horizontal attachment having opposing ends with said opposing ends inserted into said slots.

6. A holder for drying at least one bag comprising:

a base having a top surface;

a plurality of sockets wherein said top surface of said base defines holes therein to comprise said sockets;

a plurality of dowels having opposing ends with one end removably inserted into said sockets;

a plurality of spring supports having a sidewall and opposing ends with one end inserted into said end of said dowels;

a plurality of springs attached to said spring supports;

a plurality of slots wherein said opposing end of at least two of said dowels defines a slot therein to comprise said slots; and a horizontal attachment having opposing ends with said opposing ends inserted into said slots.

7. The holder for drying at least one bag as defined in claim 6, wherein said holder is selected from the group consisting of plastic, steel, aluminum, titanium, sealed wood, and carbon fiber composite.

8. The holder for drying at least one bag as defined in claim 6, wherein said dowels are of various lengths.

9. The holder for drying at least one bag as defined in claim 6, wherein said opposing end of said dowels is smooth and rounded.

10. The holder for drying at least one bag as defined in claim 6, further comprising:

a plurality of spring retainers protruding from said sidewall of said spring supports; and a plurality of spring hooks having opposing ends with one end attached to said end of said dowels and said opposing end attached to said springs.

11. The holder for drying at least one bag as defined in claim 6, wherein said sockets are interconnected.

12. The holder for drying at least one bag as defined in claim 6, wherein said base is generally trapezoidal in shape.

13. A holder for drying at least one bag comprising:

a spring having opposing ends;

a spring support having a sidewall, an open end, and a closed end with said open end receiving one end of said spring;

a spring retainer attached to said sidewall of said spring support and securing said end of said spring within said spring support;

a spring hook having opposing ends with one end connected to said opposing end of said spring;

a dowel having opposing ends with one end attached to said opposing end of said spring hook and receiving said open end of said spring support; and a base having a top surface comprising a socket therein to receive said end of said dowel.

14. The holder for drying at least one bag as defined in claim 13, wherein said holder comprises a plurality of dowels of various lengths.

15. The holder for drying at least one bag as defined in claim 13, wherein said holder is selected from the group consisting of plastic, steel, aluminum, titanium, sealed wood, and carbon fiber composite.

16. The holder for drying at least one bag as defined in claim 14, further comprising:

a plurality of slots wherein said opposing end of at least two of said dowels defines a slot therein to comprise said slots; and a horizontal attachment having opposing ends with said opposing ends inserted into said slots.

17. The holder for drying at least one bag as defined in claim 13, wherein said opposing end of said dowel is smooth and rounded.

18. The holder for drying at least one bag as defined in claim 13, wherein said top surface of said base defines a plurality of holes therein to comprise a plurality of interconnected sockets.

19. The holder for drying at least one bag as defined in claim 13, wherein said base is generally trapezoidal in shape.

* * * * *